US006887006B1

(12) United States Patent
Carpenter

(10) Patent No.: US 6,887,006 B1
(45) Date of Patent: May 3, 2005

(54) CRAYONS WITH ASSOCIATED CARRYING CASE

(76) Inventor: Timothy E. Carpenter, Rte. 2 Box 15, Wadesboro, NC (US) 28170

( * ) Notice: Subject to any disclaimer, the term of this patent is extended or adjusted under 35 U.S.C. 154(b) by 0 days.

(21) Appl. No.: 10/911,429

(22) Filed: Aug. 5, 2004

(51) Int. Cl.[7] ..... B43K 29/06; A46B 5/02; A45C 11/34; B43L 23/00

(52) U.S. Cl. ..... 401/50; 401/52; 401/6; 401/131; 206/214; 206/216; 30/453

(58) Field of Search ..... 401/50, 52, 6, 401/131; 30/451, 453; 206/214, 216, 224, 206/371

(56) References Cited

U.S. PATENT DOCUMENTS

| | | | | |
|---|---|---|---|---|
| D81,435 | S | 6/1930 | Coby | |
| 2,734,839 | A | 2/1956 | Clancy et al. | |
| 2,857,881 | A * | 10/1958 | Beebe et al. | 30/454 |
| 3,249,092 | A | 5/1966 | Moojen | |
| 4,302,121 | A | 11/1981 | Kim | |
| D284,980 | S | 8/1986 | Yoshida | |
| 4,762,493 | A * | 8/1988 | Anderson | 434/84 |
| 4,815,622 | A * | 3/1989 | Cramer | 220/4.21 |
| D316,272 | S | 4/1991 | Lee | |
| D316,730 | S | 5/1991 | Yoshida | |
| D317,940 | S | 7/1991 | Brenner | |
| 5,044,804 | A | 9/1991 | Chuang | |
| 5,441,149 | A * | 8/1995 | Willard et al. | 206/214 |
| 5,477,983 | A | 12/1995 | Davis | |
| 5,893,671 | A | 4/1999 | Bellue | |
| 6,021,891 | A * | 2/2000 | Anderson | 206/214 |
| D430,608 | S | 9/2000 | Krieglstein et al. | |

* cited by examiner

*Primary Examiner*—David J. Walczak

(57) ABSTRACT

A kit for housing an improved design for crayons includes a container with two chambers. One of the chambers is provided with a blade and a rotatable member for assisting a user to position the crayons against the blade for sharpening purposes. Also included are crayons positionable into another chamber for storage. Such crayons have a plurality of integral faces equidistantly spaced apart from a centrally disposed longitudinal axis thereof respectively. The crayon faces define a plurality of angles therebetween with each of the angles equaling approximately 60 degrees, resulting in substantially triangular cross-sections defining an isometric shape.

18 Claims, 3 Drawing Sheets

CRAYONS WITH ASSOCIATED CARRYING CASE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to crayons and, more particularly, to triangular shaped crayons and associated means for storage.

2. Prior Art

Various well known writing instruments have found common use and appeal. Examples include conventional hexagon cross-sectional pencils shaped to reduce unintended rolling and slippage, and round cross-sectional pens having polymeric slip reducing materials for the shells thereof and having cap clips for reducing rolling and for attaching to pockets. Generally, these designs have not been as ergonomically well designed for prolonged periods of use based on the way that such pencils and pens are conventionally held during extended writing periods. Additionally, many of these prior pens have a tendency to roll on desk tops due to their round shape.

At present, crayon users only utilize 50% of a crayon due to breakage or difficulty in handling the crayon after it has been used for a short period of time. This makes the use of crayons uneconomical since most of the crayon normally is not used. Furthermore, a mess is created whenever a crayon is accidentally stepped on after rolling on to the floor. Inasmuch as crayons are so widely used by people of all ages, it is highly desirable to improve the structure of the body of the crayon so that it can be more readily held in an untiring manner by the fingers of the hand of the user.

Prior attempts to improve the ergonomic designs of such writing utensils have for example lead to the use of various scooped portions for receiving the index finger or have lead to non-uniform curvatures. For pencils and crayons, the bodies of which are consumed during use, the use of a non-uniform shape would undesirably result in frequently changing grip configurations following sharpening. Also, various ergonomic pencil configurations would not be suitable for being sharpened in conventional pencil sharpeners. At present, the prior art is crowded with attempts to overcome such shortcomings.

The non-uniform design of some of these designs could result in inefficient packaging; some of the uniform designs do not provide for ease in picking up the writing utensil from a resting position; and some of the spiral designs are too tightly wound to provide for comfortable long term writing.

Accordingly, a need remains for an improved design for crayons and means to maintain the integrity of such a design. The present invention satisfies such a need by providing a triangular shaped crayon. Additionally, a carrying case including an adapted sharpening mechanism is provided for storage purposes. The improved shape of the present invention allows children of all ages to better grip the crayon and therefore improve drawing ability.

BRIEF SUMMARY OF THE INVENTION

In view of the foregoing background, it is therefore an object of the present invention to provide crayons and an associated carrying case. These and other objects, features, and advantages of the invention are provided by a kit for housing drawing utensils that can be supported on an inclined surface that includes a container having a substantially rectangular shape. The container is provided with a plurality of sides sized and shaped for defining a plurality of bifurcated and isolated chambers horizontally disposed along a longitudinal plane. Such a container includes an open top end portion and a closed bottom end portion. The container further includes a flap adjustably attached to the top end portion that is movable between open and closed positions.

One of the chambers is disposed adjacent the lower end portion and has a longitudinal axis extending perpendicular to the longitudinal plane. Such a chamber has axially opposed end portions equally spaced apart from a center of the container wherein one of the chamber's end portions is provided with an aperture and another of the chamber's end portions includes a cap threadably engageable therewith and detachable from the one chamber. Such a cap is preferably provided with a centrally disposed notch for assisting a user to remove the cap from the container. The one chamber's end portion that includes the aperture also preferably includes a rotatable flange member positioned therein for assisting a user to adjustably position the crayons adjacent the blade, which is disposed adjacent the one chamber end portion (discussed hereinbelow).

The present invention includes a plurality of elongated crayons longitudinally positionable into another of the chambers and maintained above the one chamber. The crayons have a wax-like core and a paper-like outer layer coated thereabout. Such crayons further have a plurality of integral faces equidistantly spaced apart from a centrally disposed longitudinal axis thereof respectively. The crayon faces preferably define a plurality of angles therebetween with each of the angles equaling approximately 60 degrees. Therefore, the crayons have substantially triangular cross-sections for defining an isometric shape.

Accordingly, each of the faces define a sufficient surface area for engaging a support surface and advantageously maintaining the crayon at a substantially stable position so that when the crayon is axially rotated along a radial path alternate ones of the faces will engage the support surface and maintain sufficient frictional contact therewith. Each of the crayons further have a body and a converging end portion axially extending away therefrom for engaging a writing surface.

Advantageously, the present invention further includes a mechanism for sharpening the crayons wherein the sharpening mechanism is disposed within one chamber and subjacent another chamber. Such a sharpening mechanism preferably includes a blade secured to one of the sides disposed within one chamber. The blade has an angled tip extending obliquely to the crayon axis wherein the crayon is longitudinally positionable into one chamber for engaging the blade. Additionally, the blade has a length extending upwardly from one side and protruding into a longitudinal path of the crayons during operating conditions.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
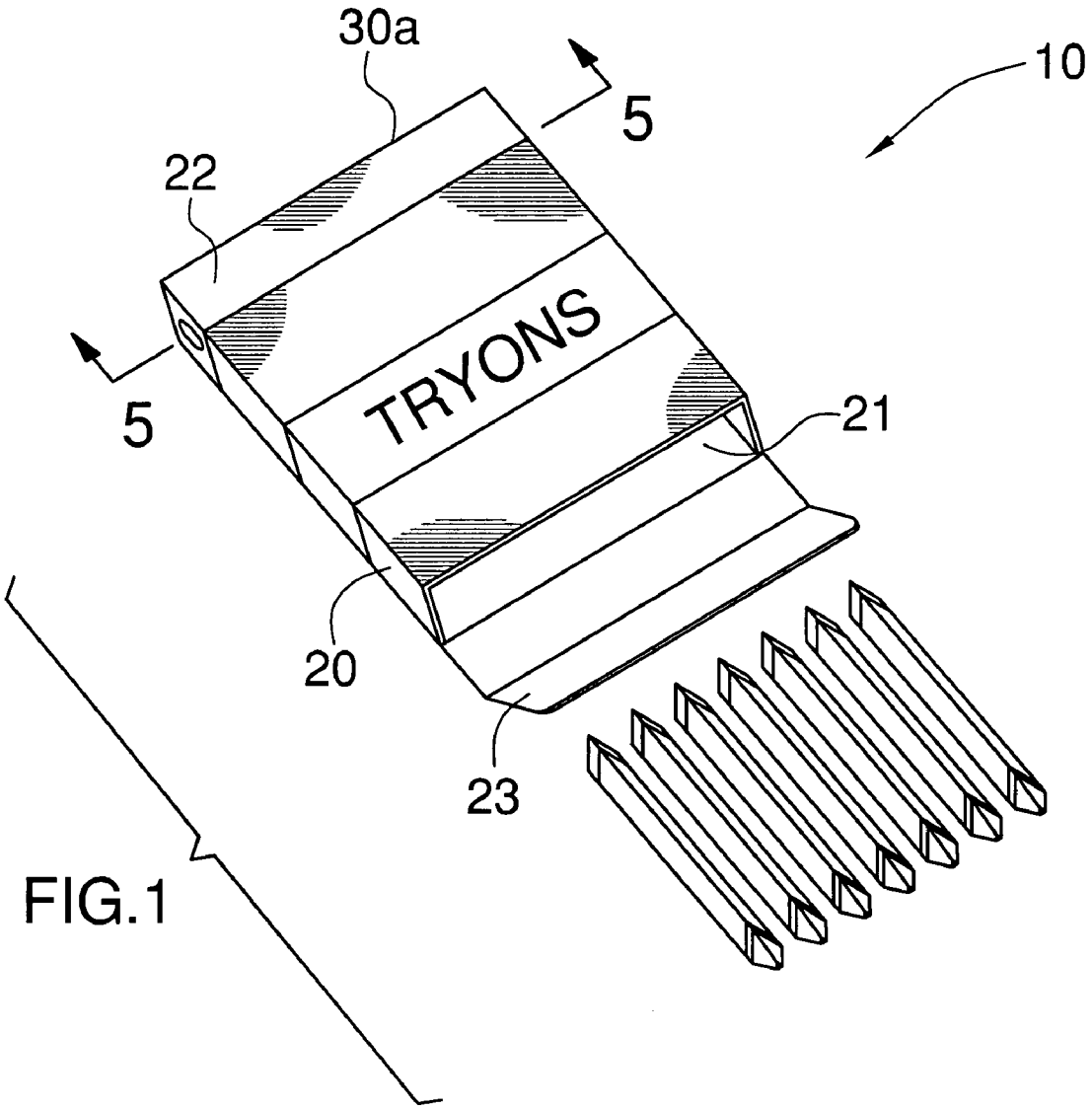
FIG. 1 is a perspective view showing a kit including improved triangular shaped crayons and associated carrying case, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–6 by the reference numeral 10 and is intended to prevent the loss or destruction of a crayon and maintain the integrity of the crayon structure. It should be understood that the apparatus 10 may be offered in a variety of colors and sizes.

Referring initially to FIG. 1, the apparatus 10 includes a container 20 having a substantially rectangular shape. The container 20 is provided with a plurality of sides sized and shaped for defining a plurality of bifurcated and isolated chambers 30*a* and 30*b* horizontally disposed along a longitudinal plane. Such a container 20 includes an open top end portion 21 and a closed bottom end portion 22. The container 20 further includes a flap 23 adjustably attached to the top end portion 21 that is movable between open and closed positions.

Figure 5:
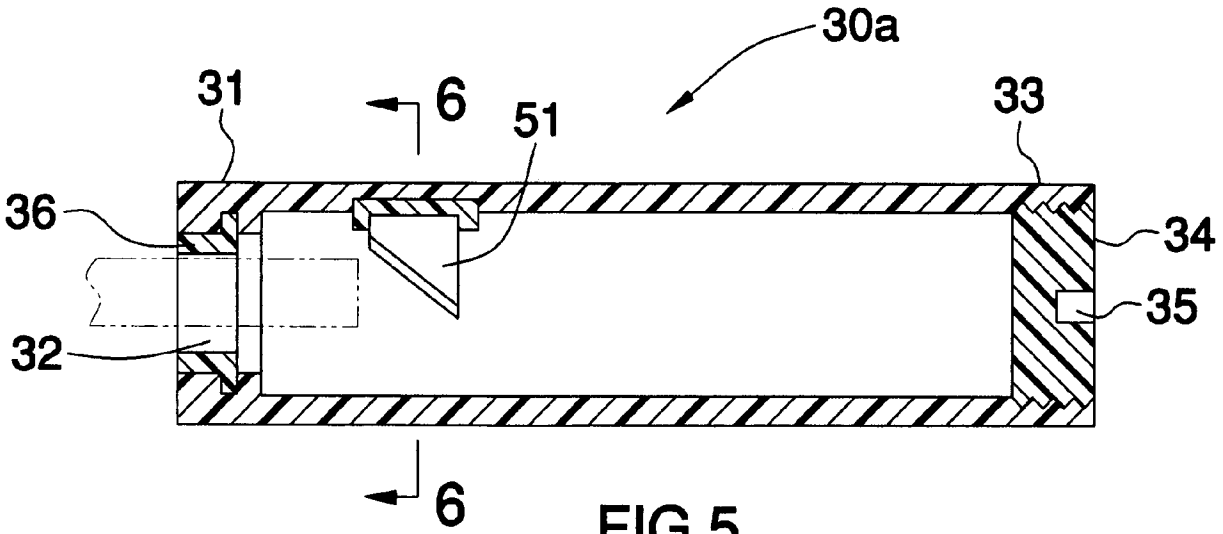
FIG. 5 is an enlarged cross-sectional view of the carrying case shown in FIG. 1, taken along line 5—5.

Now referring to FIG. 5, one chamber 30*a* is disposed adjacent the lower end portion 22 and has a longitudinal axis extending perpendicular to the longitudinal plane. Such a chamber 30*a* has axially opposed end portions equally spaced apart from a center of the container 20 wherein one of the chamber's end portions 31 is provided with an aperture 32 and another of the chamber's end portions 33 includes a cap 34 threadably engageable therewith and detachable from the chamber 30*a*. Such a cap 34 is preferably provided with a centrally disposed notch 35 for assisting a user to remove the cap 34 from the container 20. The one chamber's end portion 31 that includes the aperture 32 also preferably includes a rotatable flange member 36 positioned therein for assisting a user to adjustably position the crayons adjacent the blade 51, which is disposed adjacent the one chamber end portion 31 (discussed hereinbelow).

Figure 2:
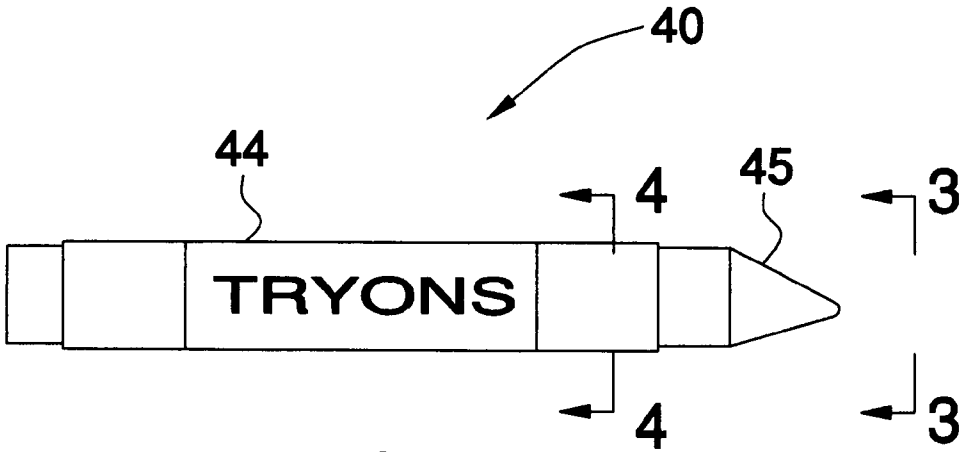
FIG. 2 is an enlarged side elevational view of one of the crayons shown in FIG. 1.
Figure 3:
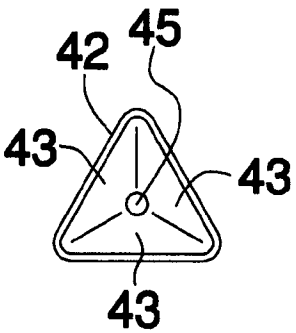
FIG. 3 is a front elevational view of the triangular crayon shown in FIG. 2.
Figure 4:
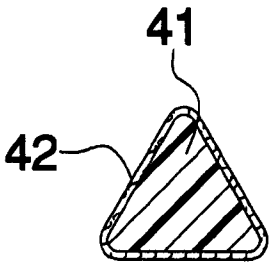
FIG. 4 is a cross-sectional view of the triangular crayon shown in FIG. 2, taken along line 4—4.

Referring to FIGS. 2–4, the present invention includes a plurality of elongated crayons 40 longitudinally positionable into another of the chambers 30*b* and maintained above one chamber 30*a*. The crayons 40 have a wax-like core 41 and a paper-like outer layer 42 coated thereabout. Such crayons 40 further have a plurality of integral faces 43 equidistantly spaced apart from a centrally disposed longitudinal axis thereof respectively. The crayon faces 43 preferably define a plurality of angles therebetween with each of the angles equaling approximately 60 degrees. Therefore, the crayons 40 have substantially triangular cross-sections for defining an isometric shape.

Accordingly, each of the faces 43 define a sufficient surface area for engaging a support surface and advantageously maintaining the crayon 40 at a substantially stable position so that when the crayon 40 is axially rotated along a radial path alternate ones of the faces 43 will engage the support surface and maintain sufficient frictional contact therewith. Additionally, the triangular shape of the crayons 40 is easier for childrens' hands to grip, thereby improving drawing ability. Each of the crayons 40 further have a body 44 and a converging end portion 45 axially extending away therefrom for engaging a writing surface.

Figure 6:
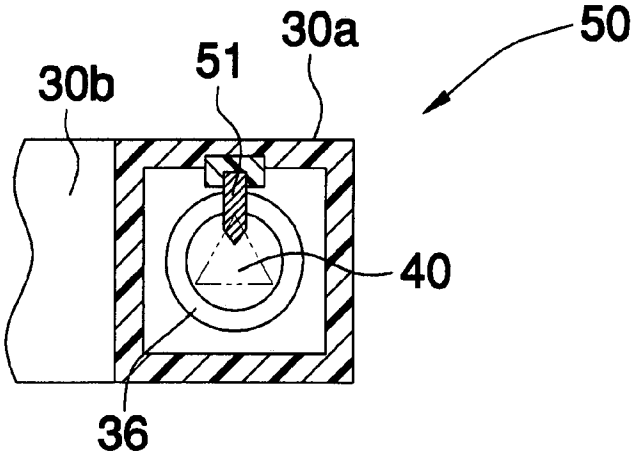
FIG. 6 is a cross-sectional view of the sharpening mechanism shown in FIG. 5, taken along line 6—6.

Now referring to FIG. 6, the present invention advantageously includes a mechanism for sharpening the crayons 40 wherein the sharpening mechanism 50 is disposed within one chamber 30*a* and subjacent another chamber 30*b*. Such a sharpening mechanism 50 preferably includes a blade 51 secured to one of the sides and disposed within one chamber 30*a*. The blade 51 has an angled tip extending obliquely to the crayon axis wherein the crayon 40 is longitudinally positionable into one chamber 30*a* for engaging the blade 51. Additionally, the blade 51 has a length extending upwardly from the one side and protruding into a longitudinal path of the crayons 40 during operating conditions.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A kit for housing drawing utensils that can be supported on an inclined surface, said kit comprising:

a container having a substantially rectangular shape and being provided with a plurality of sides sized and shaped for defining a plurality of isolated chambers horizontally disposed along a longitudinal plane, said container including an open top end portion and a closed bottom end portion, said container further including a flap adjustably attached to said top end portion and being movable between open and closed positions, one said chamber being disposed adjacent said lower end portion and having a longitudinal axis extending perpendicular to the longitudinal plane, said one chamber having axially opposed end portions equally spaced apart from a center of said container wherein one said chamber end portion is provided with an aperture and another said chamber end portion includes a cap threadably engageable therewith and detachable from said one chamber;

a plurality of crayons having a wax-like core and a paper-like outer layer coated thereabout, said crayons further having a plurality of integral faces equidistantly spaced apart from a centrally disposed longitudinal axis thereof respectively, each said face defining a sufficient surface area for engaging a support surface and maintaining said crayon at a substantially stable position so that when said crayon is axially rotated along a radial path alternate ones of said faces will engage the support surface and maintain sufficient frictional contact therewith; and means for sharpening said crayons wherein said sharpening means is disposed within said one chamber.

2. The kit of claim 1, wherein said sharpening means comprises:

a blade secured to one said sides and being disposed within said one chamber, said blade having an angled tip extending obliquely to said crayon axis wherein said crayon is longitudinally positionable into said one chamber for engaging said blade, said blade having a length extending upwardly from said one side and protruding into a longitudinal path of said crayons during operating conditions.

3. The kit of claim 2, wherein one said chamber end portion includes a rotatable flange member positioned therein and for assisting a user to adjustably position said crayons adjacent said blade, said blade being disposed adjacent said one chamber end portion.

4. The kit of claim 1, wherein said crayon faces define a plurality of angles therebetween with each said angle equaling approximately 60 degrees.

5. The kit of claim 1, wherein said crayons have substantially triangular cross-sections for defining an isometric shape.

6. The kit of claim 1, wherein said cap is provided with a centrally disposed notch for assisting a user to remove said cap from said container.

7. A kit for housing drawing utensils that can be supported on an inclined surface, said kit comprising:

a container having a substantially rectangular shape and being provided with a plurality of sides sized and shaped for defining a plurality of isolated chambers horizontally disposed along a longitudinal plane, said container including an open top end portion and a closed bottom end portion, said container further including a flap adjustably attached to said top end portion and being movable between open and closed positions, one said chamber being disposed adjacent said lower end portion and having a longitudinal axis extending perpendicular to the longitudinal plane, said one chamber having axially opposed end portions equally spaced apart from a center of said container wherein one said chamber end portion is provided with an aperture and another said chamber end portion includes a cap threadably engageable therewith and detachable from said one chamber;

a plurality of elongated crayons longitudinally positionable into another said chamber and being maintained above said one chamber, said crayons having a wax-like core and a paper-like outer layer coated thereabout, said crayons further having a plurality of integral faces equidistantly spaced apart from a centrally disposed longitudinal axis thereof respectively, each said face defining a sufficient surface area for engaging a support surface and maintaining said crayon at a substantially stable position so that when said crayon is axially rotated along a radial path alternate ones of said faces will engage the support surface and maintain sufficient frictional contact therewith; and means for sharpening said crayons wherein said sharpening means is disposed within said one chamber and subjacent said another chamber.

8. The kit of claim 7, wherein said sharpening means comprises:

a blade secured to one said sides and being disposed within said one chamber, said blade having an angled tip extending obliquely to said crayon axis wherein said crayon is longitudinally positionable into said one chamber for engaging said blade, said blade having a length extending upwardly from said one side and protruding into a longitudinal path of said crayons during operating conditions.

9. The kit of claim 8, wherein one said chamber end portion includes a rotatable flange member positioned therein and for assisting a user to adjustably position said crayons adjacent said blade, said blade being disposed adjacent said one chamber end portion.

10. The kit of claim 7, wherein said crayon faces define a plurality of angles therebetween with each said angle equaling approximately 60 degrees.

11. The kit of claim 7, wherein said crayons have substantially triangular cross-sections for defining an isometric shape.

12. The kit of claim 7, wherein said cap is provided with a centrally disposed notch for assisting a user to remove said cap from said container.

13. A kit for housing drawing utensils that can be supported on an inclined surface, said kit comprising:

a container having a substantially rectangular shape and being provided with a plurality of sides sized and shaped for defining a plurality of bifurcated and isolated chambers horizontally disposed along a longitudinal plane, said container including an open top end portion and a closed bottom end portion, said container further including a flap adjustably attached to said top end portion and being movable between open and closed positions, one said chamber being disposed adjacent said lower end portion and having a longitudinal axis extending perpendicular to the longitudinal plane, said one chamber having axially opposed end portions equally spaced apart from a center of said container wherein one said chamber end portion is provided with an aperture and another said chamber end portion includes a cap threadably engageable therewith and detachable from said one chamber;

a plurality of elongated crayons longitudinally positionable into another said chamber and being maintained above said one chamber, said crayons having a wax-like core and a paper-like outer layer coated thereabout, said crayons further having a plurality of integral faces equidistantly spaced apart from a centrally disposed longitudinal axis thereof respectively, each said face defining a sufficient surface area for engaging a support surface and maintaining said crayon at a substantially stable position so that when said crayon is axially rotated along a radial path alternate ones of said faces will engage the support surface and maintain sufficient frictional contact therewith, each said crayon further having a body and a converging end portion axially extending away therefrom and for engaging a writing surface; and means for sharpening said crayons wherein said sharpening means is disposed within said one chamber and subjacent said another chamber.

14. The kit of claim 13, wherein said sharpening means comprises:

a blade secured to one said sides and being disposed within said one chamber, said blade having an angled tip extending obliquely to said crayon axis wherein said crayon is longitudinally positionable into said one chamber for engaging said blade, said blade having a length extending upwardly from said one side and protruding into a longitudinal path of said crayons during operating conditions.

15. The kit of claim 14, wherein one said chamber end portion includes a rotatable flange member positioned therein and for assisting a user to adjustably position said crayons adjacent said blade, said blade being disposed adjacent said one chamber end portion.

16. The kit of claim 13, wherein said crayon faces define a plurality of angles therebetween with each said angle equaling approximately 60 degrees.

17. The kit of claim 13, wherein said crayons have substantially triangular cross-sections for defining an isometric shape.

18. The kit of claim 13, wherein said cap is provided with a centrally disposed notch for assisting a user to remove said cap from said container.

* * * * *